US007695334B2

(12) United States Patent
Yonover et al.

(10) Patent No.: US 7,695,334 B2
(45) Date of Patent: Apr. 13, 2010

(54) WATER-ACTIVATED AND LIGHT-ASSISTED VISUAL LOCATING DEVICE

(76) Inventors: Robert N. Yonover, 219 Koko Isle Cir., Honolulu, HI (US) 96825; Kevin Dean Schnitzer, 18806 Country Road 5740, Castroville, TX (US) 78009; Richard James Elder, 493 Coronado Blvd., Universal City, TX (US) 78148

( * ) Notice: Subject to any disclaimer, the term of this patent is extended or adjusted under 35 U.S.C. 154(b) by 0 days.

(21) Appl. No.: 11/826,604

(22) Filed: Jul. 17, 2007

(65) Prior Publication Data

US 2008/0070457 A1 Mar. 20, 2008

Related U.S. Application Data

(63) Continuation of application No. 11/482,781, filed on Jul. 5, 2006, now abandoned.

(60) Provisional application No. 60/697,477, filed on Jul. 7, 2005.

(51) Int. Cl.

| | |
|---|---|
| ***B63C 9/01*** | (2006.01) |
| ***B63C 9/08*** | (2006.01) |
| ***B63C 9/20*** | (2006.01) |
| ***B63B 45/00*** | (2006.01) |

(52) U.S. Cl. ..... 441/36; 441/80; 441/83; 441/89; 116/26; 116/109

(58) Field of Classification Search ..... 441/11–20, 441/36, 80–101; 116/202, 209–211, 26
See application file for complete search history.

(56) References Cited

U.S. PATENT DOCUMENTS

| | | | | |
|---|---|---|---|---|
| 21,050 | A | 7/1858 | Hyatt | |
| 34,079 | A | 1/1862 | Ward | |
| 35,507 | A | 6/1862 | Colburn | |
| 3,164,801 | A | 1/1965 | Nicholl | |
| 3,431,569 | A | 3/1969 | Gerke | |
| 3,952,694 | A * | 4/1976 | McDonald | 116/209 |
| 4,475,476 | A | 10/1984 | Howard | |
| 4,725,252 | A * | 2/1988 | McNeil | 441/89 |
| 5,245,943 | A * | 9/1993 | Hull et al. | 116/202 |
| 5,344,351 | A * | 9/1994 | Danielson | 441/89 |
| 5,421,287 | A * | 6/1995 | Yonover | 116/209 |
| 6,066,016 | A * | 5/2000 | Yonover | 441/40 |
| 6,619,831 | B2 * | 9/2003 | Kanesaka | 362/555 |

FOREIGN PATENT DOCUMENTS

| | | | |
|---|---|---|---|
| CA | 2130326 A | * | 2/1996 |
| FR | 2390327 | | 12/1978 |

(Continued)

*Primary Examiner*—Ajay Vasudeva
(74) *Attorney, Agent, or Firm*—Shlesinger, Arkwright & Garvey LLP

(57) ABSTRACT

A visual locating device comprises an elongate, inherently buoyant, flexible sheet for floating on the surface of a body of water that has a longitudinal axis. At least three buoyant support struts are secured to the sheet and disposed across the longitudinal axis of the sheet such that the sheet is divided into a plurality of sections defined between respective pairs of struts. A light source is disposed on the sheet to provide nighttime visibility to the sheet. A pouch, which receives the sheet when stowed, is configured to release the sheet when immersed in water. The sheet is at least z-folded inside the pouch.

22 Claims, 7 Drawing Sheets

FOREIGN PATENT DOCUMENTS

| | | | |
|---|---|---|---|
| FR | 2626547 | | 8/1989 |
| GB | 744522 | | 2/1956 |
| JP | 07304492 | A * | 11/1995 |
| JP | 2002037189 | A * | 2/2002 |
| WO | WO 83/03915 | | 11/1983 |
| WO | WO 99/24314 | | 5/1999 |
| WO | WO 2007/008738 | | 1/2007 |

* cited by examiner 10
12
14
6
8
18
32
34
24
2
16
20
22
30
36
4
26
28

WATER-ACTIVATED AND LIGHT-ASSISTED VISUAL LOCATING DEVICE

RELATED APPLICATIONS

This is a continuation of application Ser. No. 11/482,781, filed Jul. 5, 2006 now abandoned, which claims the benefit of provisional application Ser. No. 60/697,477, filed Jul. 7, 2005, now abandoned.

FIELD OF THE INVENTION

The present invention relates generally to devices to help locate missing persons stranded at sea or the like during day or nighttime hours and particularly to a visually-located, water-activated elongate brilliantly colored streamer with light source for nighttime visibility that may be attached to a person, life jacket, flight suit, life raft, boat, or the like.

BACKGROUND OF THE INVENTION

During recent years, airline/maritime travel and recreational activities over water have increased in record numbers, both commercially and privately, as well as in the military. A direct consequence of increased travel and recreational activities over large bodies of water, such as oceans and lakes, has been a proportional increase in the number of maritime accidents that often result in persons stranded on the grand expanse of the water surface. Very few of these people are successfully rescued due to the difficulty in locating their bodies on the open ocean in daylight hours, let alone at night in which most rescue efforts are called off. A similar situation exists for persons lost over land from travel or recreational activities. More specifically on the military application level, fighter pilots are commonly injured during ejection seat extraction episodes, but nevertheless need to provide a visual distress signal to be located and recovered.

Up until now there have been three major features lacking in the "state of the art" emergency locating devices for persons lost at sea: (1) a device which is automatically deployed and sustained for an indefinite time; (2) a device which can be located from great altitudes and distances during both daylight and nighttime hours; and (3) an inexpensive simple device which can be supplied to all overseas travelers, enthusiasts, and military personnel.

The present invention increases the likelihood of locating individual persons, life rafts, or boats afloat at sea in an inexpensive, continuous manner, during both day and nighttime hours, thus making the common traveler, worker, water enthusiast, or military personnel more relaxed when separated from land (or when in desolate land areas).

OBJECTS AND SUMMARY OF THE INVENTION

An object of the present invention is to provide a water-activated visually attracting streamer, which when deployed will provide a much larger and more distinct visual target, thus increasing the chances of a successful aerial or water-based rescue of a person lost at sea.

Another object of the present invention is to provide a continuous uninterrupted visual signal in the form of a streamer that includes an active light source to attract air or waterborne rescuers, which can be detected during all hours of the day or night.

Still another object of the present invention is to provide a visually attracting streamer that can be deployed automatically upon immersion in water.

Another object of the present invention is provide a continuous uninterrupted visual signal in the form of a streamer that includes an active light source that can be viewed from the vertical (aerial) or horizontal (water-based) directions by rescue teams, regardless of the orientation of the streamer.

Yet another object of the present invention is to provide a means for storing the streamer in a compact manner, until such time as when the streamer is deployed.

Another object of the present invention is to provide a streamer which is z-folded and contained in a water-soluble pouch or configured to open when immersed in water that is mounted on a person, life jacket or flight jacket when not in use. A larger version of the water-activated streamer can also be mounted to a life raft or boat.

Yet another object of the present invention is to provide a streamer which can be inexpensively produced, providing all commercial, private, and military users with an increased chance of being spotted in an open ocean, any large water mass, or desolate land area.

In summary, the present invention provides a visual locating device comprising an elongate, inherently buoyant, flexible sheet for floating on the surface of a body of water that has a longitudinal axis. At least three buoyant support struts are secured to the sheet and disposed across the longitudinal axis of the sheet such that the sheet is divided into a plurality of sections defined between respective pairs of struts. A buoyant light source is disposed on the sheet to provide nighttime visibility to the sheet.

In another aspect of the present invention, a pouch, which receives the sheet when stowed, is configured to release the sheet when immersed in water.

In still another aspect of the present invention, the sheet is at least z-folded inside the pouch.

These and other objects of the present invention will become apparent from the following detailed description.

BRIEF DESCRIPTIONS OF THE DRAWINGS

DETAILED DESCRIPTION OF THE INVENTION

Figures 1, 2, 3, 4:
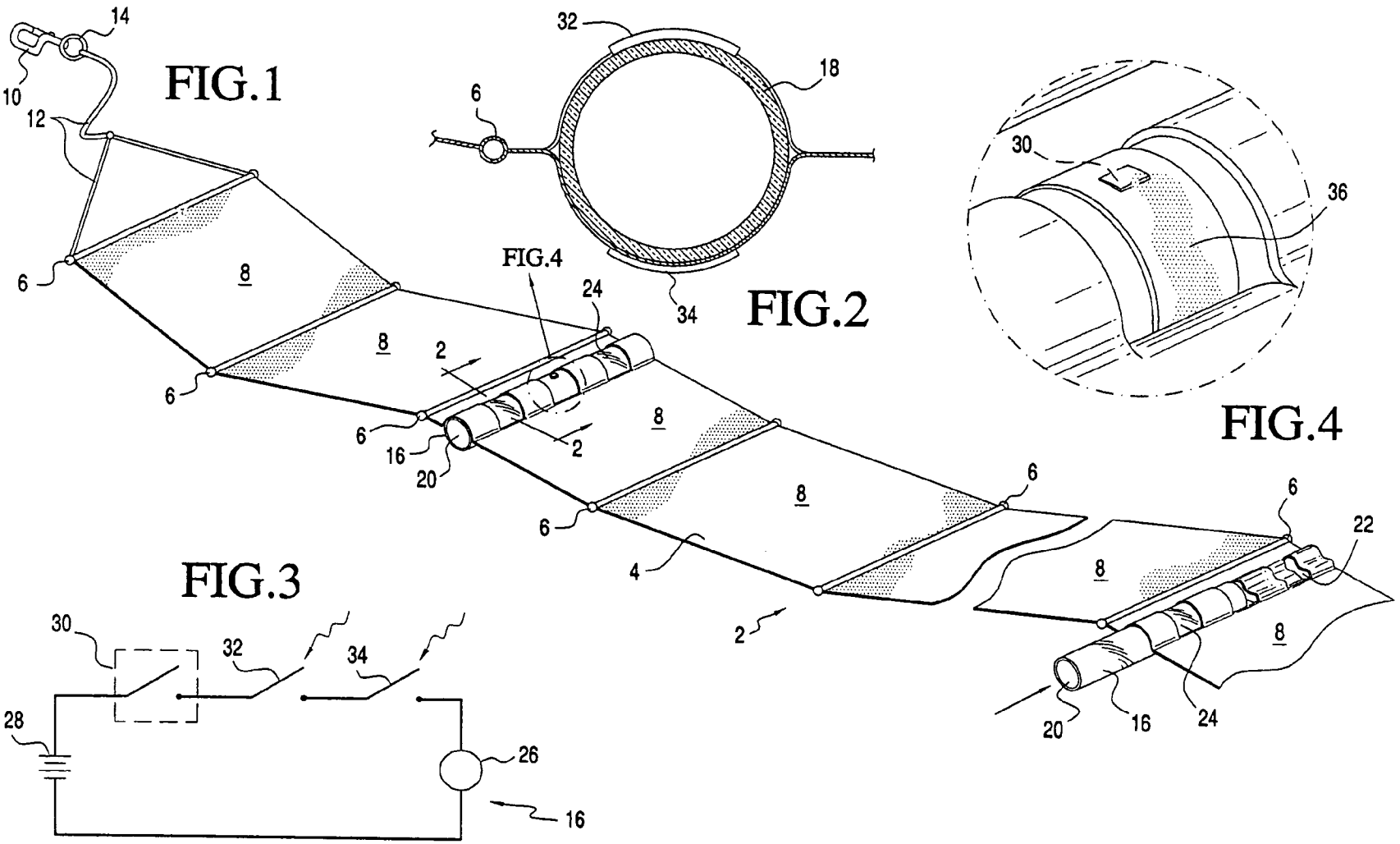
FIG. 1 is a fragmentary perspective view of a locating device made in accordance with the present invention, shown in the deployed position.
FIG. 2 is a cross-sectional view taken along line 2-2 of FIG. 2.
FIG. 3 is a schematic wiring diagram of the electrical circuit of a light source used in the present invention.
FIG. 4 is an enlarged detail of the automatic switch shown in FIG. 1.
Figure 5:
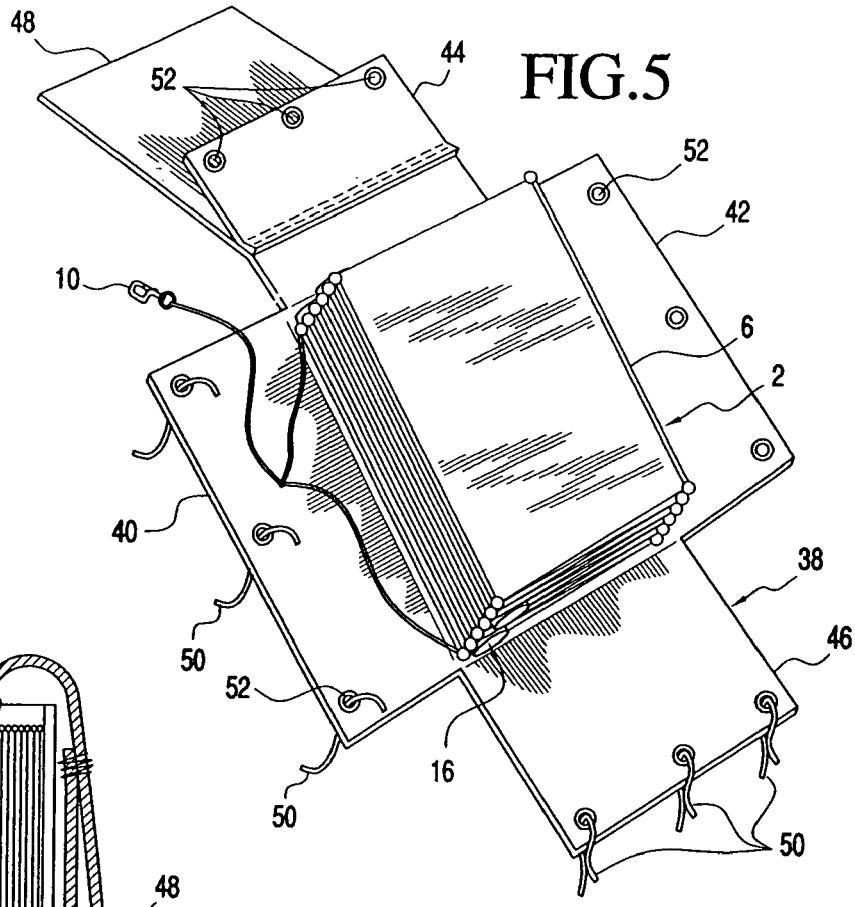
FIG. 5 is a perspective view of the locating device of FIG. 1 shown z-folded in an open pouch.
Figure 6:
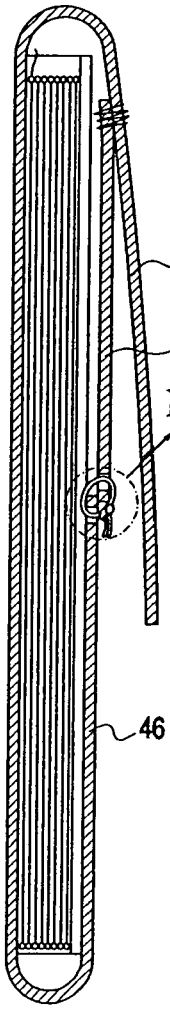
FIG. 6 is a cross-sectional view taken along line 6-6 of FIG. 14, with the side flaps omitted for clarity.
Figure 7:
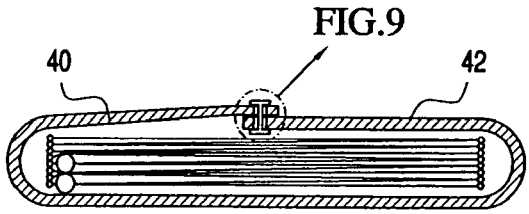
FIG. 7 is a cross-sectional view taken along line 7-7 of FIG. 14, with the top and bottom flaps omitted for clarity.

A visual locating device 2 made in accordance with the present invention is disclosed in FIG. 1. The device 2 in the form of a streamer comprises an elongate, inherently buoyant, flexible sheet 4 having a longitudinal axis along its length. Buoyant support struts 6 are secured to the sheet 4 transversely to the longitudinal axis such that the sheet 4 is divided into a plurality of sections 8 defined between respective pairs of struts 6, preferably secured at regular intervals along the length of the sheet 4. A clip 10 is secured to one end of the sheet 4 with a string 12 secured to an end strut. The clip 10 includes a swivel 14 tied directly to the string 12 to advantageously minimize twisting of the sheet 4. Even if a twist does develop, the sheet 4 will right itself by having the twist migrate all the way to the end of the sheet as it slowly flips over as it moves through the water (or on land as it is moved by the air currents).

The buoyant support struts 6 advantageously enhance the horizontal and vertical planar flotation of the sheet 4, prevent the twisting of the sheet and enhance the overall strength of the deployed sheet. The struts also advantageously provide rigidity and strength to the sheet. The struts effectively make the sheet to somewhat behave like multiple interconnected sections between adjacent pairs of struts, helping the sheet to dampen and dissipate the wave actions. The struts also advantageously prevent the sheet from maintaining its z-folded configuration in memory and thereby interfere in the deployment by effectively breaking up the continuous sheet into multiple sections. The buoyant support struts are small diameter tubes secured by adhesive or other conventional means to the sheet at regular intervals substantially perpendicularly to the longitudinal axis of the sheet 4. The small diameters of the struts advantageously permit the streamer to be z-folded into a relatively small total area.

Active light sources 16, preferably slender and cylindrically-shaped, are attached transversely to the sheet 4. At least one-light source 16 may be used, but any number may be installed. Each light source 16 may be LEDs, standard incandescent or other flashlight-type bulbs powered by batteries, which may be recharged by solar cells. The light source 16 may also be chemically powered, where the light is generated from a chemical reaction. The presently preferred light source 16 is a light stick that allegedly incorporates trade secret and other proprietary features for extended battery life and other features from Donald S. McGlauflin, doing business as Mikro Designs, whose last known address is 139 Chambers Street, Ridgecrest, Calif. 93555, donm@mikrodesigns.com, www.mikrodesigns.com Each light source 16 has a hollow cylindrical housing 18, advantageously transparent, to allow the light within to shine through. The housing 18 advantageously makes the light source floatable and rigid and serves a similar purpose to the struts 6. The housing 18 contains the electrical components of the light source, including the batteries and the light bulbs. The end faces 20 of the housing are advantageously transparent to provide visibility in the horizontal direction. The light sources 16 thus provide light in all directions, thereby ensuring that signaling light is sent into the air at various angles to alert aircraft, boats, and land-based search parties. The presence of more than one light source advantageously provides a linear lighted signal for search parties, thereby capitalizing on the ability of the human eye to pick out linear features that are not normally found in nature (especially at the surface of the ocean).

Further, multiple light sources can be provided along the length of the streamer using light flash patterns to create apparent motion, with day/night sensors to restrict light operation to night, and with a constant "on" low level during the "off" state between bright flashes. The constant "low level on" state provides an improved depth perception for a searcher to home in on, and addresses the problem of an observer blinking and missing a strobe light flash that might only be 1/10,000 of a second in duration. Alternatively, a bouncing pattern can be used that runs from end to end in a continuous manner with one light station on at all times. This multiple light station embodiment is believed to be the most effective from a purely observational viewpoint, but may be simplified to reduce manufacturing costs. Alternatively, colored solid state light emitting diodes can be used with colors selected to substantially match the detection ability (sensitivity) of a detector, whether the detector is an unaided human eye or present or future night vision goggles.

Each light source 16 is attached to the sheet 4, preferably by interweaving through a plurality of slits 22. Interweaving advantageously provides alternating exposed sections 24 of the housing 18 regardless of which surface of the sheet 4 is facing upwardly. In this manner, the light source 16 will always be visible to a search and rescue aircraft even though the sheet 4 may rotate along its longitudinal axis due to wave action. Other standard ways for securing the light source to the sheet 4, while at the same time making it visible regardless of the orientation of the sheet 4, may be used. For example, a section of the sheet 4 to which the light source is attached may be made transparent so that the light source 16 may be simply glued to the transparent section, rather than interweaving through the slits 22.

The electrical components of the light source 16 are schematically shown in FIG. 3. The light source 16 includes a light bulb 26 powered by a battery 28. Switches 30, 32 and 34 are, connected in series between the light bulb 26 and the battery 28 to control the operation of the light bulb 26. The switch 30 is normally in the off position when the device 2 is stowed and preferably automatically turns to the on position when the device 2 is deployed. The switch 30 may also be manually operated; however, automatic operation of the switch 30 is preferred in case the user is injured when he hits the water so that no manual intervention is required to turn on the light source 16. Switches 32 and 34 are preferably solar-activated photo sensors that are used to conserve battery power by turning off the light bulb during the daytime and turning it on during the nighttime. The switches 32 and 34 may be replaced by a manual switch (where the main switch 30 is automatically on) to conserve battery power. Automatic cycling between day and nighttime, provided by the photo sensors, is preferred, however, in case the user is injured and cannot manually operate the switch.

The switch 30 is preferably a micro switch held in the off position by a water soluble sleeve 36. When the device 2 is immersed in water, the sleeve 36 dissolves away, thereby releasing the switch 30 to the close position. Other automatic activation of the switch 30 in conjunction with the deployment of the device 2 may be used. For example, the switch 30 may be a reed switch where its associated magnet is pulled by a string to turn on the switch by the unfurling action of the sheet 4.

The switches 32 and 34 are disposed diametrically opposite each other, shown in FIG. 2, such that when one of the switches, for example switch 32, is facing upwardly, the other switch 34 is facing downwardly toward the bottom of the water. In this manner, the switch 34 will be closed, since it is not exposed to the sunlight, and the switch 32 will be open during daytime and closed during nighttime. During nighttime, when the device 2 is deployed, both switches 32 and 34 would be closed and the main switch 30 would also close (automatically or manually), and the light bulb 26 would be energized. The light source 16 can be visible light (white or other colors), infrared light (IR), ultraviolet light (UV) or any combination of light sources as applicable. Note that for military applications, IR light is highly desirable for covert rescue scenarios where night vision goggles (NVG's) are standard equipment for nighttime missions.

The sheet 4 is preferably made from a bright orange colored plastic sheet. The sheet may also include, but is not limited to, radiation reflective surface colors/materials, such as pigmented material (fluorescent), night-glowing material (phosphorescent), radar-reflective material, mirror-like reflective material or any combination of the above or other vision enhancing, eye catching material. The phosphoric material will enable natural and/or artificial light from the normal operation of the respective vessel (aircraft or maritime) to charge the phosphoric particles contained in the night glowing material, producing a signal which will "glow in the dark" in the case of a nighttime accident. If an accident takes place during the day or if the missing person is not found within the first day, the natural radiation emanating from the sun will effectively charge the phosphoric particles in the sheet, providing an enhanced nighttime signal for an infinite number of nights (recharged each day). An alternative light source for the deployed streamer is bioluminescence, such as a chemical extract from the "fire fly" insect.

Figure 16:
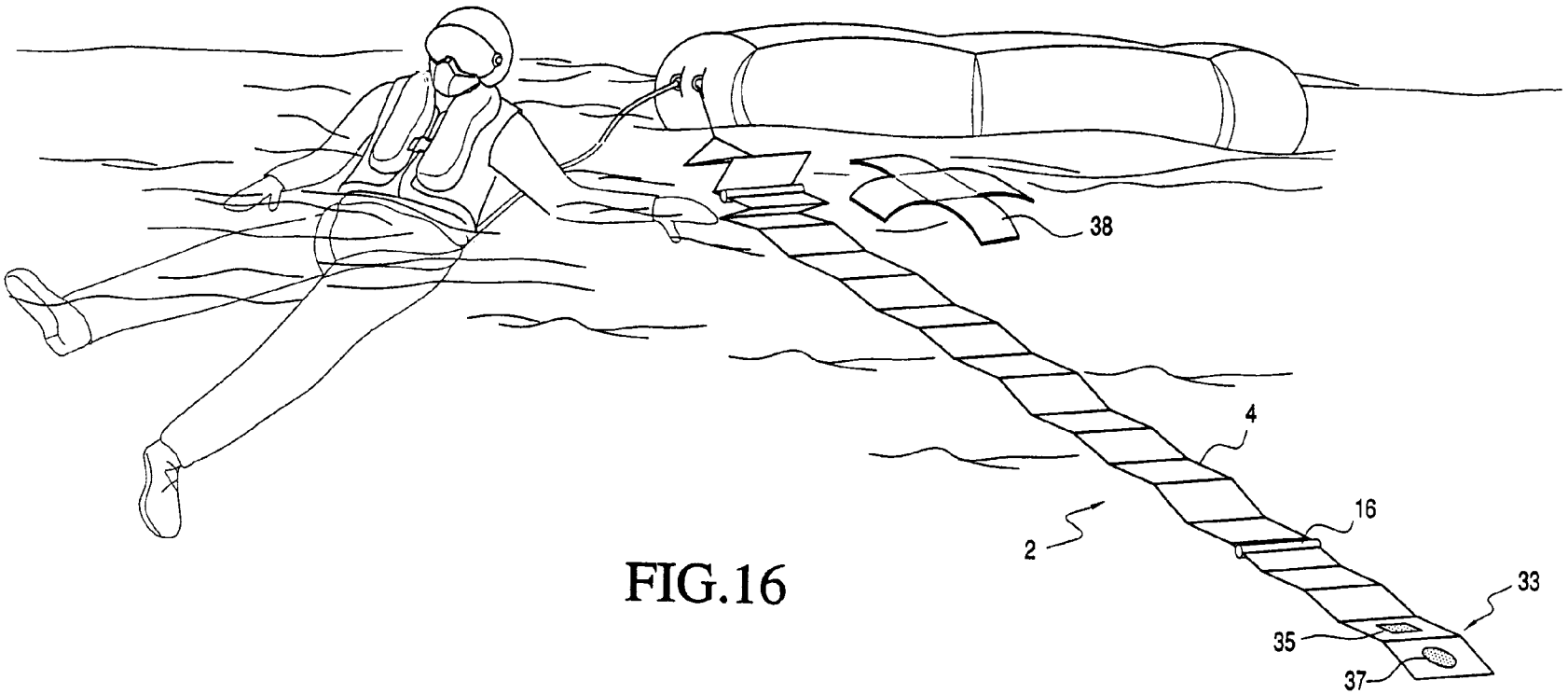
FIG. 16 shows the locating device of FIG. 1 in the process of unfolding from its z-folded configuration after the pouch opened up after being immersed in water.

In addition to the coloring of the sheet material, international distress signal indicia 33 (see FIG. 16) may be imprinted on the free-end of the sheet and can be located in additional places along the length of the sheet for additional signaling. The indicia comprise a black square indicia 35 disposed next to a black circle indicia 37. At least one international distress signal indicia is required, but additional ones increase the likelihood of visual detection under a variety of environmental conditions.

Alternating sections of visually enhancing materials can be arranged vertically as a striped pattern. Many other patterned combinations are possible, including horizontal stripes that may be the most cost efficient to manufacture. In addition, the visually enhanced character of the sheet can be found on both sides of the streamer material to maximize aerial visibility, especially in the possible case where the sheet may become twisted.

The device 2 without the light sources 16 is disclosed in U.S. Pat. No. 5,421,287, which is hereby incorporated by reference.

Figure 8:
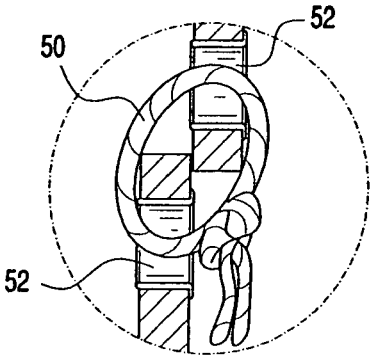
FIG. 8 is an enlarged detail taken from FIG. 6.
Figure 9:
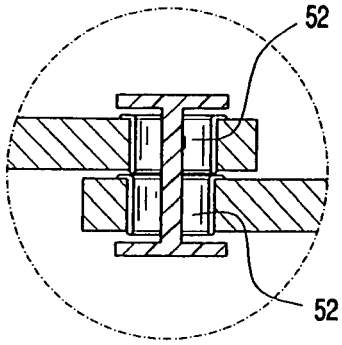
FIG. 9 is an enlarged detail taken from FIG. 7.

The device 2 is preferably z-folded and stowed in a pouch 38. The pouch is made from a flat sheet of material with side flaps 40 and 42, top and bottom flaps 44 and 46 and a top protective flap 48. The side flaps 40 and 42 are folded over the z-folded sheet 4 and the flaps are joined to each other with water soluble ties 50 threaded through aligned holes 52 along their outer edges. Similarly, the top and bottom flaps 44 and 46 are folded over the flaps 40 and 42, thereby covering the water-soluble ties 50. The top and bottom flaps 44 and 46 are tied together with water-soluble ties 50 threaded through aligned holes 52 along their outer edges. The ties 50 may be in the form of a string that can be tied together with a knot, as best shown in FIG. 8, or they may be in the form of an I-shaped plastic part that may be bent and threaded through the holes 52, as shown in FIG. 9. A protective flap 48 overlies the final securing points on the flaps 44 and 46 to hide the last or outer water-soluble tie attachment points, so that no water-soluble ties are exposed when the pouch 38 is folded up and in the stowed position. The side flaps 40 and 42 are folded first, followed by the top and bottom flaps 44 and 46.

The protective flap 48 advantageously protects the water-soluble ties from inadvertently dissolving upon exposure to rain or water splashing. The water soluble tie material is available from MonoSol (USA), Fortage, Ind. 46482. The pouch material is preferably water resistant.

Preferably, the water soluble ties are formed from a flat sheet of water soluble material, by rolling it up into a cord or lacing, placing heat shrink tubing on the ends, searing the exposed ends of the rolled material (which extends slightly outside the outboard side of the heat shrink tips) with a flame or high heat to flare the ends, so the ends do not come back through the heat shrink tips. The final product resembles a "shoe lace", which has great strength both along the axis of the "shoe lace" and also across the width of the "shoe lace." The amount or width of the flat sheet of material that is rolled up, and how tightly the material is rolled, helps control the ultimate dissolving time of the lacing and the release point within the device being time-released while immersed in water.

Figure 10:
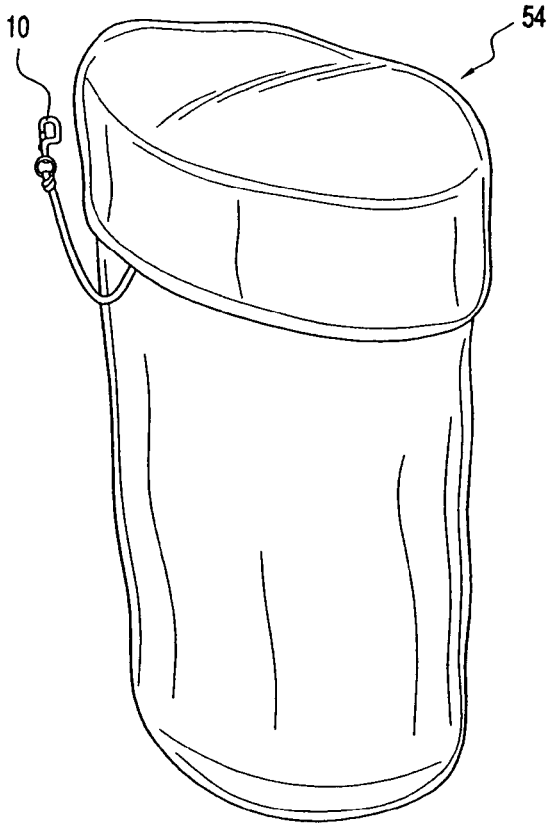
FIG. 10 is an embodiment of a water-soluble pouch used to stow the locating device of FIG. 1.
Figure 12:
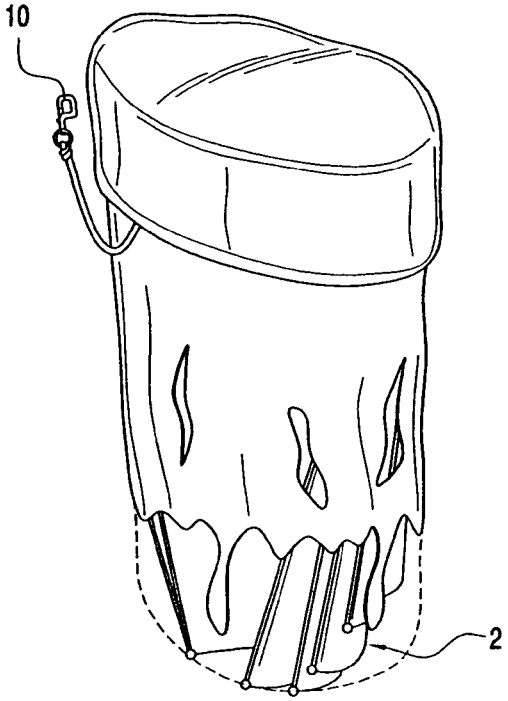
FIG. 12 shows the pouch of FIG. 10 in the process of dissolving after having been immersed in water.

A water-soluble pouch 54 may also be used, as shown in FIG. 10. The pouch 54 is preferably made from the same material as the water-soluble ties 50. The z-folded sheet 4 is rolled and placed inside the pouch 54. The clip 10 is advantageously placed outside the pouch and secured to some attachment point on a person's clothing, life jacket, flight suit, life raft, boat, etc. When the pouch 54 is immersed in water, it will start to dissolve, as best shown in FIG. 12, eventually releasing the device 2 within.

Figure 14:
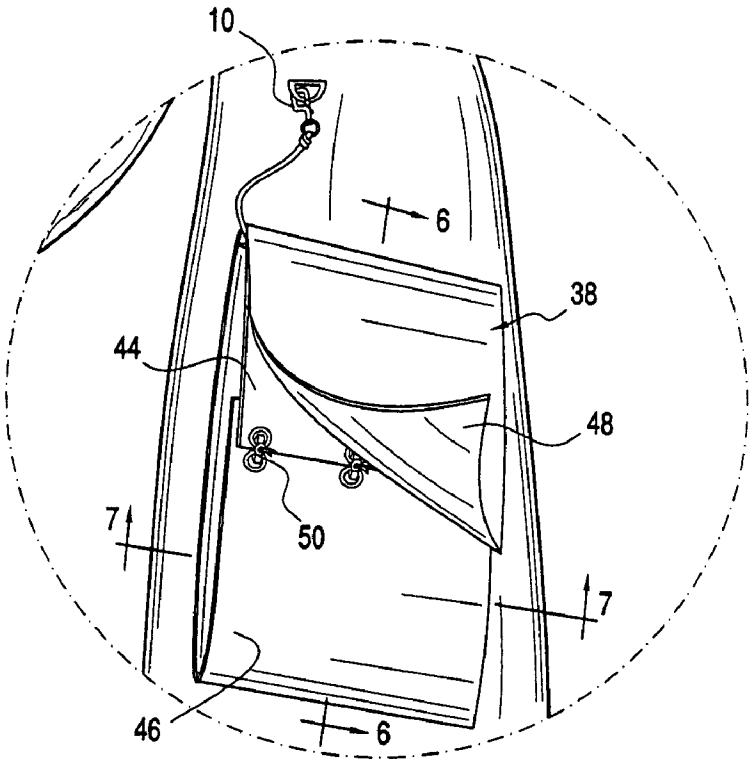
FIG. 14 is an enlarged detail taken from FIG. 13.
Figure 13:
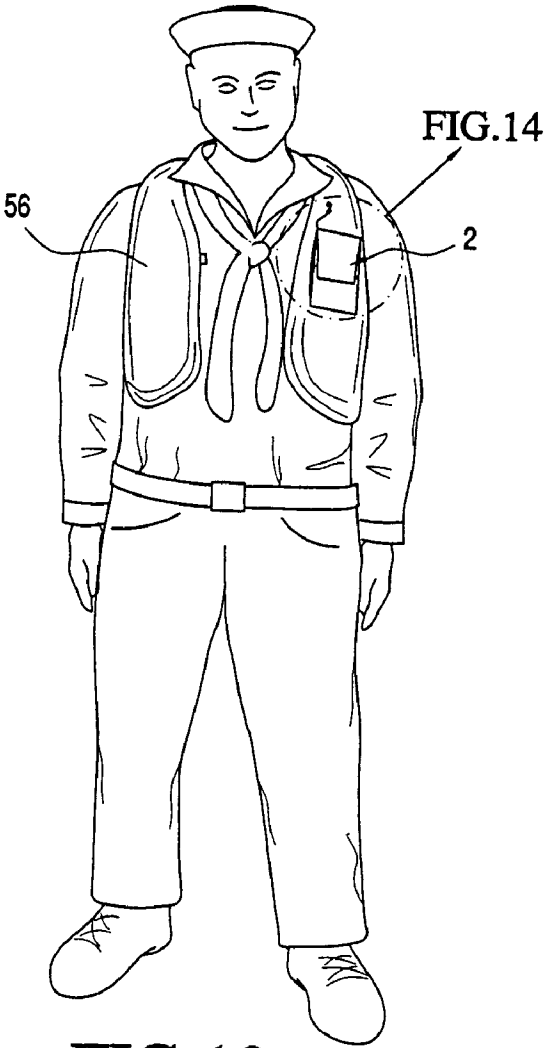
FIG. 13 shows a sailor wearing the locating device of FIG. 1 on this life-jacket.

The device 2 in the pouch 38 may be secured to a person's life jacket 56, as best shown in FIGS. 13 and 14. The pouch 38 is secured to the life jacket by standard means, such as by hook-loop fastener (not shown) at the back of the pouch. The clip 10 is preferably secured to an attachment point, such as a D-ring, on the life jacket. Note that the protective flap 48 overlays the attachment ties 50 to advantageously protect them from accidental wetting.

Figure 11:
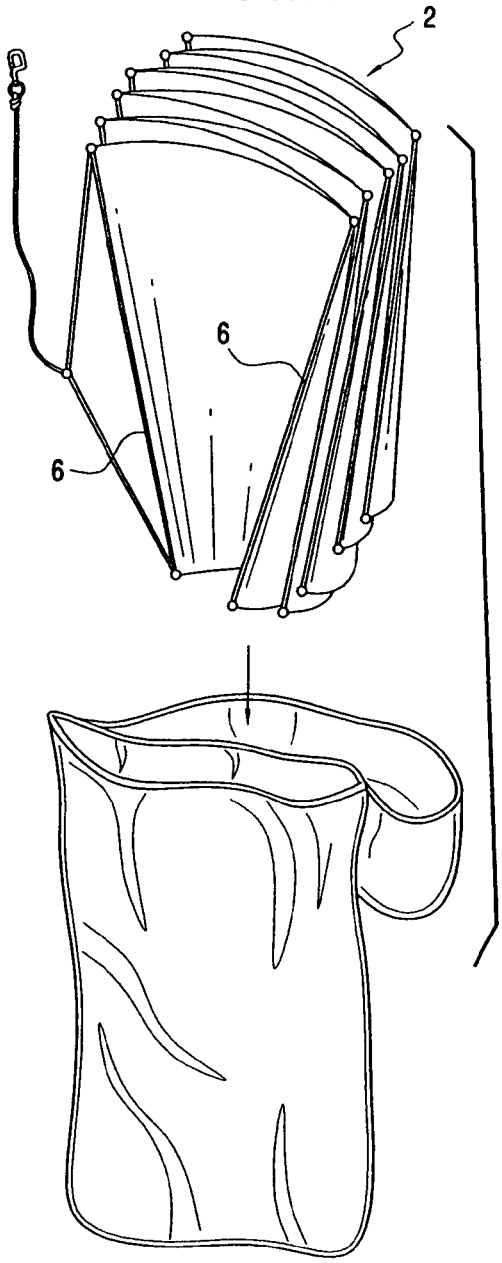
FIG. 11 shows the locating device of FIG. 1, z-folded and rolled, as it is being inserted into the pouch of FIG. 10.
Figure 15:
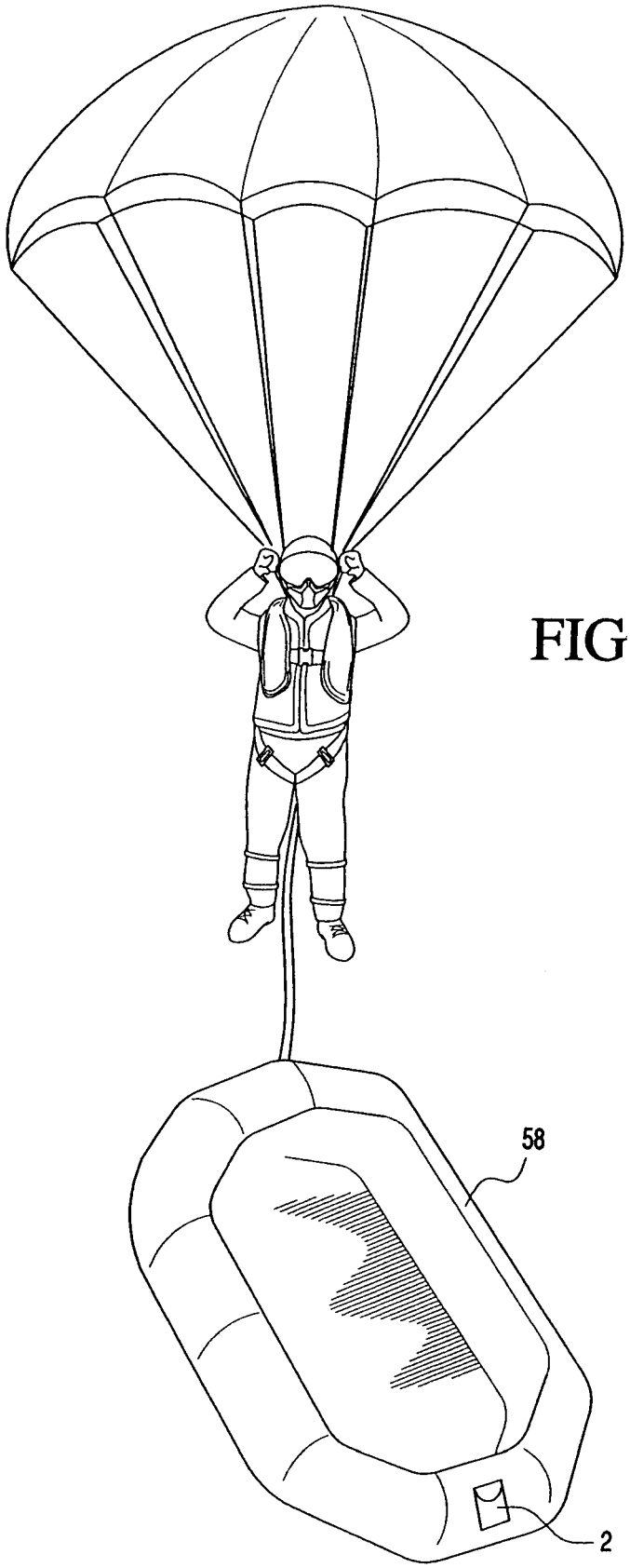
FIG. 15 shows the locating device of FIG. 1 attached to a life raft of a pilot.

A larger version of the device 2 may be attached to a life raft 58, as shown in FIG. 15. When the life raft and the pouch hit the water, the ties will dissolve from immersion in the water, opening up the pouch and releasing the z-folded sheet 4 stowed within. The z-folding of the sheet 4 (see FIGS. 11 and 16) advantageously facilitates the unfolding of the sheet. Automatic deployment of the sheet 4 is preferred in case the user is injured and unconscious when he hits the water. In this manner, the sheet is deployed without intervention from the user, and is ready to visually attract a search and rescue team.

Figure 17:
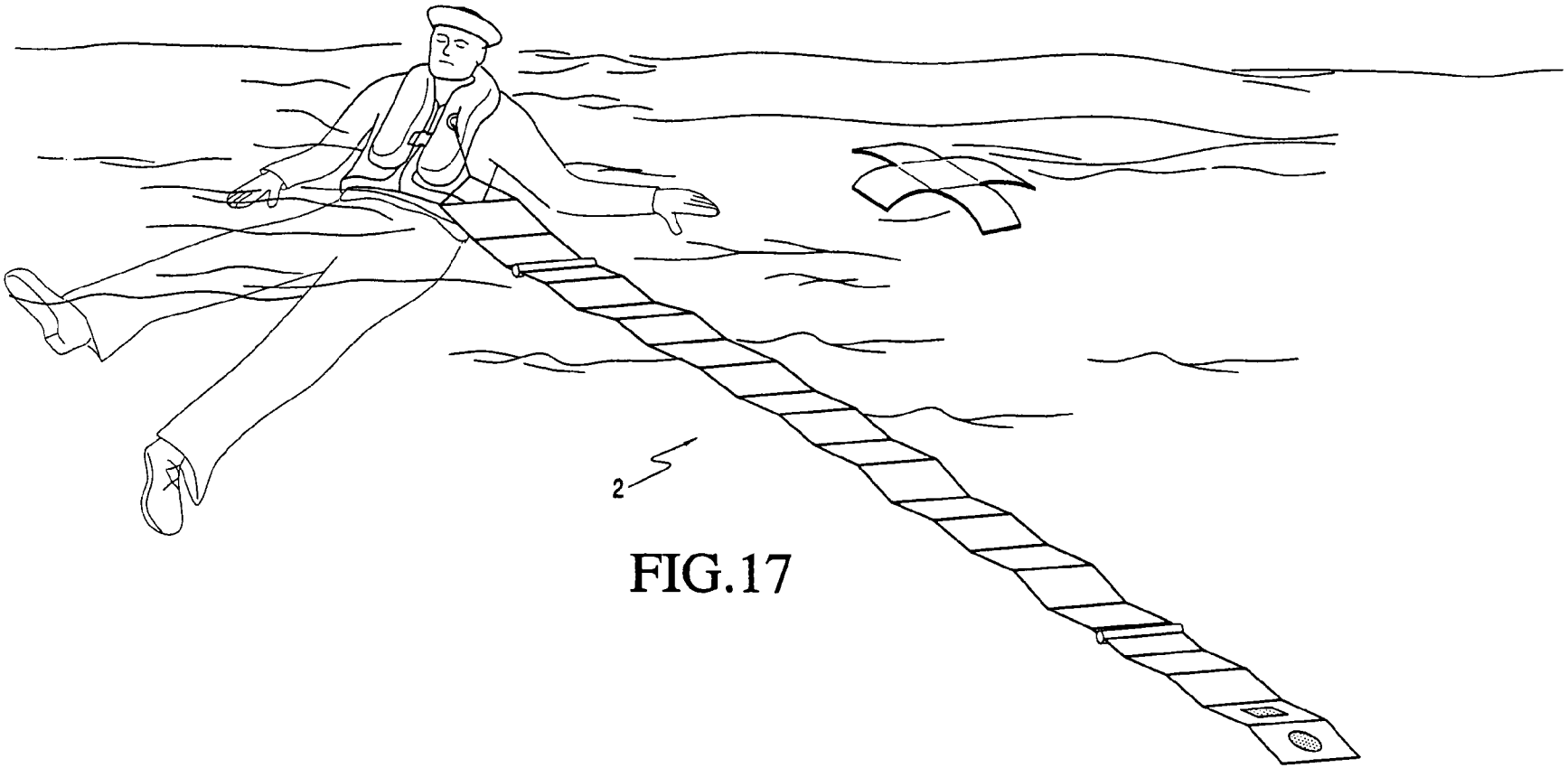
FIG. 17 shows the locating device of FIG. 1 fully deployed and attached to a sailor's life-jacket.

The device 2 is shown deployed and attached to a sailor in FIG. 17. Upon immersion in water, the water-soluble ties 50 dissolve, enabling the pouch 38 to open up and unfold, permitting the z-folded sheet 4 to become exposed to the water currents and deploy/unfurl automatically with the aid of water/wind currents and the differential drift component of a person versus the streamer material. The user can also swim in the opposite direction during the unfurling of the sheet 4 to enhance its deployment, especially in the case of extremely calm sea conditions. The sheet 4 is outstretched to achieve maximum visible surface area. The sheet 4 is maintained in a horizontal planar position on the surface of the water by the intrinsic buoyancy of the sheet material and by the buoyant support struts 6 affixed to the sheet at fixed intervals. The buoyant support struts enhance the horizontal and vertical planar flotation of the sheet, prevent the twisting of the sheet material and enhance the overall strength/durability of the deployed sheet, especially in rough water conditions. In case the sheet becomes twisted or tangled by rough seas or any other unforeseeable processes, the clip 10 with its fully rotating swivel 12 about the axis of twisting advantageously permits the sheet to be untwisted, thus keeping the sheet at its maximum signal surface area.

The device 2 advantageously enhances the vertical (aerial) and horizontal (water or ground-based) visibility of the sailor or any person (or boat) stranded at sea or on land by effectively marking his position in a continuous automatic manner upon immersion in water. More specifically on the military application level, fighter pilots are commonly injured during ejection seat extraction episodes, but nevertheless need to provide a visual distress signal to be located and recovered. The device 2 is attached to the life jacket worn by a survivor or the life raft attached to an ejection seat of the pilot and automatically deploys upon immersion in water by means of a pouch constrained by water-soluble ties or a water-soluble pouch. The light sources 16 are automatically deployed upon immersion in water. The switches 32 and 34, which are photocell sensors, advantageously permit the light sources to automatically turn on and off during day/night sequences, thereby conserving battery power.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) an active light source disposed on said sheet to provide nighttime visibility to said sheet;

d) said light source including a buoyant longitudinal housing disposed transversely to said longitudinal axis of said sheet;

e) said sheet including a plurality of slits transverse to said struts and aligned across said longitudinal axis; and f) said housing is interwoven through said slits.

2. A visual locating device as in claim 1, wherein said light source comprises:

a) a light emitting device;

b) a portable power source connected to said light emitting device; and c) a first switch connected in series with said power source to control said light emitting device.

3. A visual locating device as in claim 2, wherein said first switch is off when said sheet is stowed and selectively on when said sheet is deployed.

4. A visual locating device as in claim 2, wherein said first switch is automatically turned on when said sheet is deployed.

5. A visual locating device as in claim 4, wherein:

a) a sleeve presses down on said first switch to an open position; and b) said sleeve is water soluble such that when said sheet is immersed in water, said sleeve dissolves and releases said first switch to a closed position.

6. A visual locating device as in claim 2, and further comprising:

a) second and third switches connected in series with each other and said first switch;

b) one of said second and third switches is off during daytime; and c) said second and third switches are closed during nighttime.

7. A visual locating device as in claim 2, and further comprising:

a) second and third switches which are solar activated; and b) said second and third switches are disposed vertically opposed to each other with respect to said sheet floating on water such that one of said second and third switches is facing toward the sky and thereby subject to solar activation and the other is submerged and facing downwardly toward the bottom of the water and thereby not subject to solar activation.

8. A visual locating device as in claim 1, wherein said light source includes LED.

9. A visual locating device as in claim 1, wherein said, light source includes an incandescent source.

10. A visual locating device as in claim 1, wherein said sheet is stowed in a z-folded configuration in a pouch that releases said sheet when immersed in water.

11. A visual locating device as in claim 10, wherein said pouch is made of water-soluble material.

12. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) a pouch for receiving said sheet when stowed;

d) said sheet is a folded sheet when stowed inside said pouch;

e) said pouch is a flat sheet on which said folded sheet is disposed, said flat sheet including first and second side flaps, and top and bottom flaps folded over said folded sheet; and f) water-soluble ties securing said flaps in place.

13. A visual locating device as in claim 12, and further comprising a cover flap overlying said flaps.

14. A visual locating device as in claim 12, wherein:

a) said first and second side flaps are folded over said folded sheet and secured together with a first set of water-soluble ties;

b) said top and bottom flaps are folded over said first and second side flaps to cover said first set of water-soluble ties, said top and bottom flaps are secured together with a second set of watersoluble ties; and c) a cover flap disposed over said second set of water-soluble ties.

15. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) a light source disposed to provide nighttime visibility to said sheet;

d) said light source including a longitudinal housing;

e) said sheet including a plurality of slits; and f) said housing is interwoven through said slits.

16. A visual locating device as in claim 15, wherein:

a) said slits are transverse to said struts and aligned across said longitudinal axis; and b) said housing is disposed transversely to said longitudinal axis of said sheet.

17. A visual locating device as in claim 15, wherein said housing is buoyant.

18. A visual locating device as in claim 15, and further comprising:

a) a pouch made of a flat sheet including first and second side flaps, and top and bottom flaps, said flexible sheet being folded and disposed on said flat sheet;

b) said first and second side flaps are folded over said folded sheet and secured together with a first set of watersoluble ties; said top and bottom flaps are folded over said first and second side flaps to cover said first set of water-soluble ties, said top and bottom flaps are secured together with a second set of water-soluble ties; and c) a cover flap disposed over said second set of water-soluble ties.

19. A visual locating device as in claim 18, wherein said sheet is z-folded.

20. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) an active light source disposed on said sheet to provide nighttime visibility to said sheet;

d) a portable power source connected to said light source;

e) a first switch connected in series with said power source to control said light source;

f) a sleeve presses down on said first switch to an open position; and g) said sleeve is water soluble such that when said sheet is immersed in water, said sleeve dissolves and releases said first switch to a closed position.

21. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) an active light source disposed on said sheet to provide nighttime visibility to said sheet;

d) a portable power source connected to said light source;

e) a first switch connected in series with said power source to control said light source;

f) second and third switches connected in series with each other and said first switch;

g) one of said second and third switches is off during daytime; and h) said second and third switches are closed during nighttime.

22. A visual locating device, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pairs of struts;

c) an active light source disposed on said sheet to provide nighttime visibility to said sheet;

d) a portable power source connected to said light source;

e) a first switch connected in series with said power source to control said light source, said first switch is turned on when said sheet is deployed;

f) second and third switches connected in series with each other and said, first switch;

g) said second and third switches are closed during nighttime;

h) said second and third switches are solar activated; and i) said second and third switches are disposed vertically opposed to each other with respect to said sheet floating on water such that one of said second and third switches is facing toward the sky and thereby subject to solar activation and the other is submerged and facing downwardly toward the bottom of the water and thereby not subject to solar activation.

* * * * *